US005778855A

United States Patent [19]

Czekala et al.

[11] Patent Number: 5,778,855

[45] Date of Patent: Jul. 14, 1998

[54] COMBUSTION STABILITY CONTROL FOR LEAN BURN ENGINES

[75] Inventors: Michael Damian Czekala, Canton; Thomas Evans Jones, Waterford, both of Mich.

[73] Assignee: Ford Global Technologies, Inc., Dearborn, Mich.

[21] Appl. No.: 887,855

[22] Filed: Jul. 3, 1997

[51] Int. Cl.[6] ..... F02P 5/00

[52] U.S. Cl. ..... 123/416; 123/417; 324/388

[58] Field of Search ..... 123/416, 417, 123/423; 328/388, 399

[56] References Cited

U.S. PATENT DOCUMENTS

| | | | |
|---|---|---|---|
| 4,918,389 | 4/1990 | Schleupen et al. | 324/399 |
| 5,076,234 | 12/1991 | Fukui et al. | 123/417 |
| 5,146,893 | 9/1992 | Ohsawa | 123/425 |
| 5,197,431 | 3/1993 | Takaba et al. | 123/423 |
| 5,215,067 | 6/1993 | Shimasaki et al. | 123/630 |
| 5,253,627 | 10/1993 | Miyata et al. | 123/435 |
| 5,309,884 | 5/1994 | Fukui et al. | 123/481 |
| 5,334,938 | 8/1994 | Kugler et al. | 324/399 |
| 5,337,716 | 8/1994 | Fukui et al. | 123/425 |
| 5,343,844 | 9/1994 | Fukui et al. | 123/481 |
| 5,383,432 | 1/1995 | Cullen et al. | 123/406 |
| 5,383,433 | 1/1995 | Fiorenza et al. | 123/416 |
| 5,396,176 | 3/1995 | Ishii et al. | 324/388 |
| 5,425,339 | 6/1995 | Fukui | 123/416 |
| 5,483,818 | 1/1996 | Brandt et al. | 73/35.01 |
| 5,507,264 | 4/1996 | Kugler et al. | 123/481 |

*Primary Examiner*—Raymond A. Nelli
*Attorney, Agent, or Firm*—Allan J. Lippa

[57] ABSTRACT

A control system for determining combustion quality in a combustion chamber of an internal combustion engine. For each combustion chamber, first and second sampling windows are generated and ionic currents sampled utilizing the spark plug as an electrode. In response to the samples, indications of combustion quality such as misfire, late combustion, and slow combustion are provided. When the engine is operating in a lean burn mode, rich correction are made to the engine air/fuel ratio in an amount dependent upon the combustion quality indications.

15 Claims, 4 Drawing Sheets

COMBUSTION STABILITY CONTROL FOR LEAN BURN ENGINES

BACKGROUND OF THE INVENTION

The invention relates to combustion quality or stability control. In a particular aspect of the invention, the invention relates to combustion stability control for lean burn engines.

It is known to operate internal combustion engines at air/fuel ratios lean of stoichiometry for improved fuel economy. In such lean operation, however, conventional air/fuel feedback control responsive to typical 2-state exhaust gas oxygen sensors is not feasible because such sensors provide information only at stoichiometric air/fuel ratios. The resulting lack of feedback control may result in air/fuel operation which is too lean resulting in engine misfire, or engine roughness. It is also known to enrich the engine air/fuel ratio in response to a misfire detection.

The inventors herein have recognized a problem with the above approaches. For example, correcting lean air/fuel operation by a rich correction in response to a misfire detection may still result in uncorrected rough engine operation at lean air/fuel ratios. Further, the rich correction may be greater than necessary to prevent engine roughness resulting in loss of fuel economy.

SUMMARY OF THE INVENTION

An object of the invention herein is to determine combustion quality of an engine including indications of misfire, late combustion, and slow combustion. A further object is to adjust engine air/fuel operation in response to the combustion quality indications.

The above object is achieved, and problems of prior approaches overcome, by a method for determining combustion quality in a combustion chamber of an internal combustion engine. In one particular aspect of the invention, the method comprises generating a first window of a first predetermined duration after an ignition event in the combustion chamber; generating a second window of a second predetermined duration after said first window; sampling ionic current flow in the combustion chamber at predetermined sample times during said first window; sampling ionic current flow in the combustion chamber at predetermined sample times during said second window; and providing a combustion condition indication based upon said ionic current samples occurring during said first window and said ionic current samples occurring during said second window.

Preferably, the invention further comprises delivering fuel to the engine to operate the enginene at a first air/fuel ratio lean of stoichiometry and increasing the delivered fuel in response to the combustion condition and indication to operate the engine at a second air/fuel ratio lean of stoichiometry which is richer than said first air/fuel ratio.

An advantage of the above aspect of the invention is that actual combustion quality is provided rather than merely an indication of whether or not the engine is misfiring. A further advantage of the invention is that engine air/fuel operation is corrected in response to such combustion quality indications. This is particularly advantageous in lean burn engines wherein engine air/fuel ratio is corrected in a rich air/fuel direction by an amount needed to prevent engine roughness rather than by an arbitrary fixed amount dependent upon only one operating condition.

BRIEF DESCRIPTION OF THE DRAWINGS

The object and advantages described herein will be more fully understood by reading the following example of an embodiment in which the invention is used to advantage with reference to the drawings wherein.

DESCRIPTION OF THE PREFERRED EMBODIMENT

Figure 1:
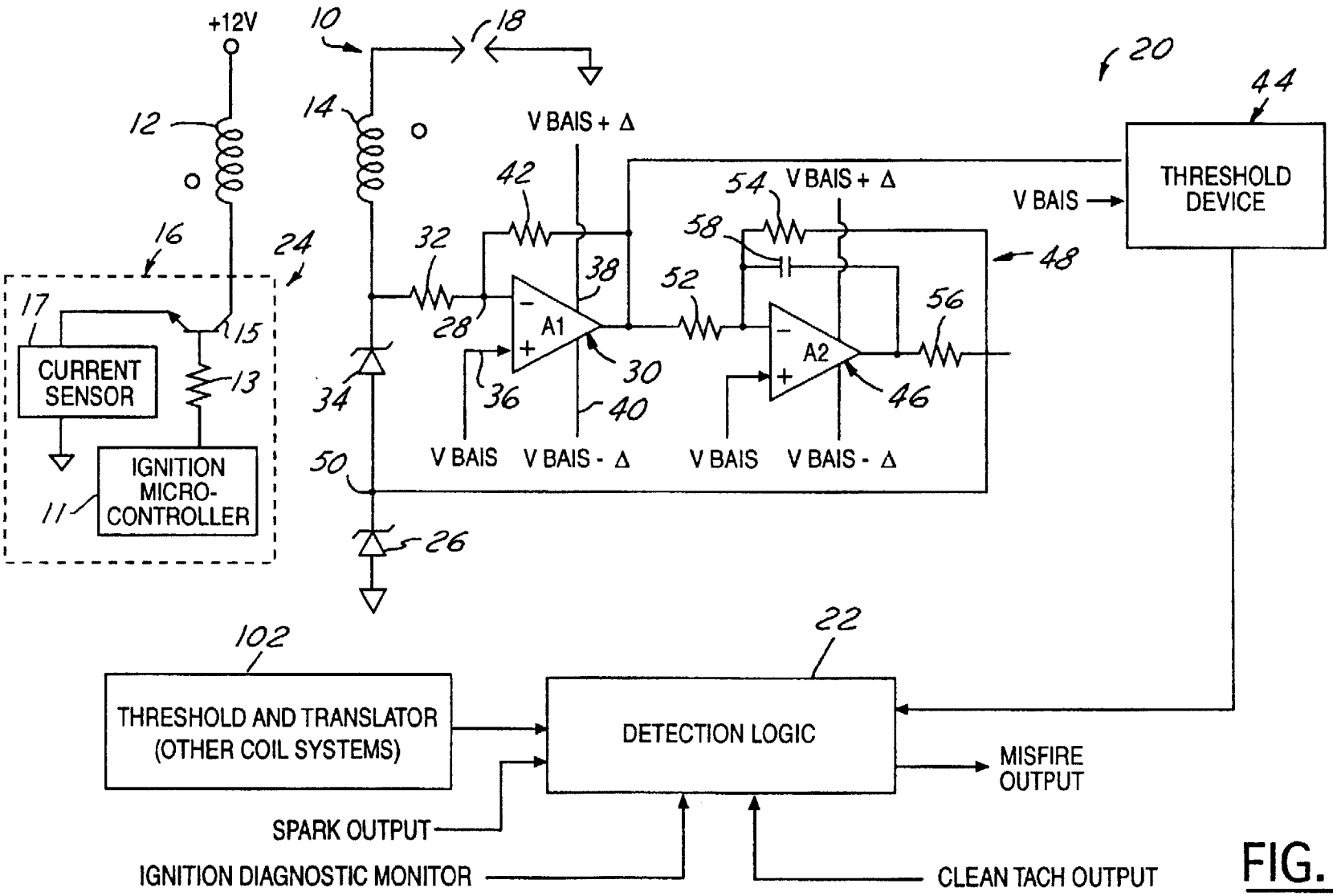
FIG. 1 is a schematic of a circuit and block diagram in which the invention is used to advantage.

Referring now to FIG. 1 ignition coil 10, of an ignition system for an internal combustion engine, includes a primary winding 12 and an isolated secondary winding 14. Preferably, the ignition coil used is a coil-on-plug (COP) ignition coil. The coils of a COP are unique in that the coils are magnetically biased so that a greater charge can be applied and therefore higher energy can be obtained from a smaller coil package. This bias does not impact the function of the ionization detection system.

The ignition system includes a coil switching device, generally indicated at 16, which, in turn, includes an ignition microcontroller 11, a resistor 13, a transistor 15, and a current sensor 17. Resistor 13 preferably has a value of 1 kilohm. The ignition system further includes a spark plug 18.

FIG. 1 also shows apparatus or a circuit, generally indicated at 20, for detecting ionic current in the ignition system after combustion of fuel in the engine. Finally, FIG. 1 shows a block diagram of detection logic 22 with various vehicle inputs for providing a misfire output signal. There is only one set of detection logic 22 for the vehicle, not one per cylinder. Also, more than one coil-spark plug combination can be connected to the input of the circuit 20 at node 24.

It has been found that two coils per circuit 20 is optimum to keep signals from encroaching upon the time slices reserved for others. This phenomenon becomes prevalent at high RPM.

Three signals from the vehicle are required by the detection logic 22. These are:

1. Ignition Diagnostic Monitor, IDM —The IDM occurs synchronously with the spark event. One positive pulse per firing event is used to identify the start of the ignition discharge. The IDM pulse for cylinder 1 has a different pulse width so that cylinder identification and synchronization can be achieved.

2. Clean Tack Output, CTO —One negative pulse per cylinder event. Negative edge occurs 9 crank degrees before top dead center.

Figure 2:
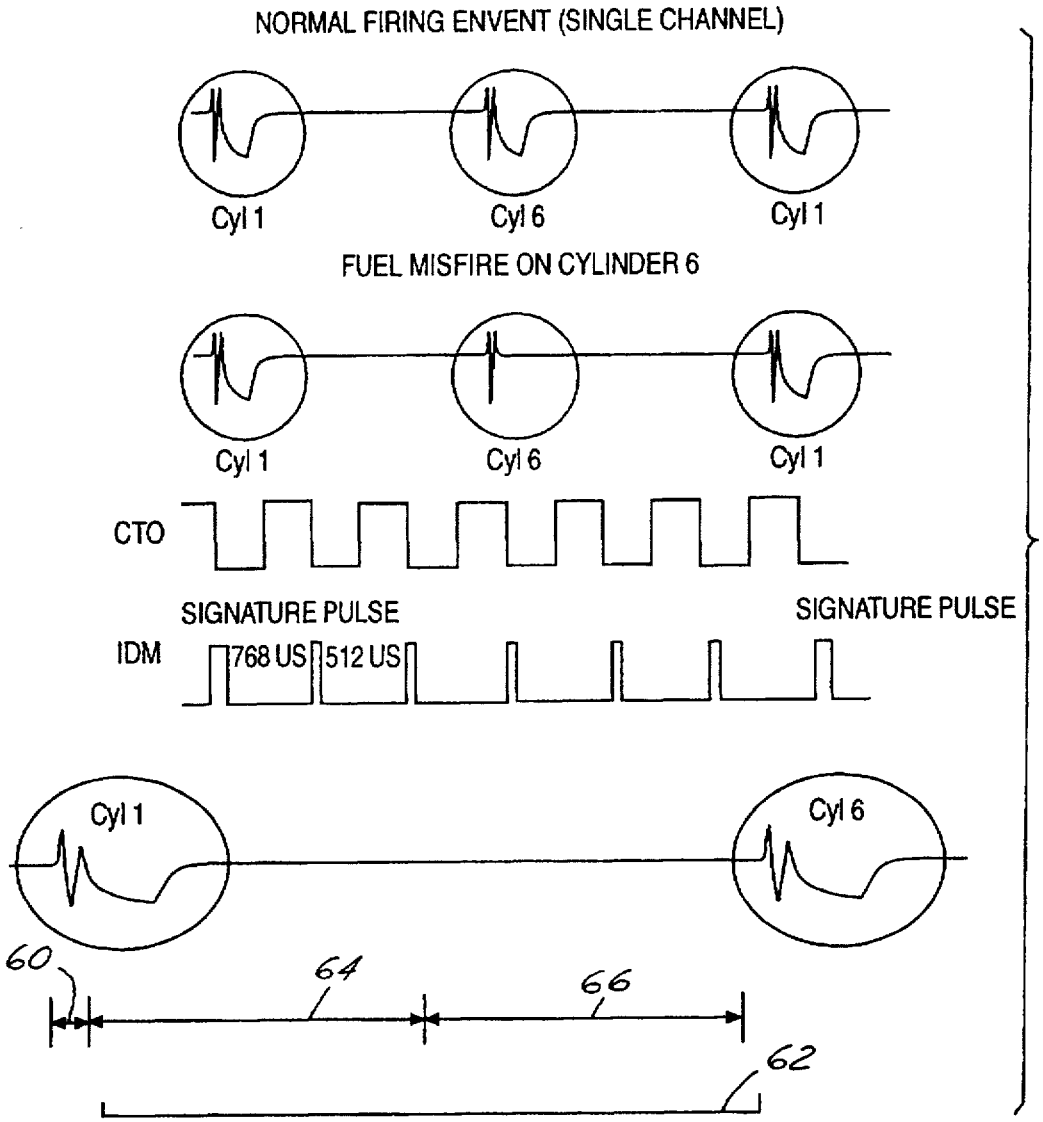
FIG. 2 represents various waveforms associated with the embodiment shown in FIG. 1.

FIG. 2 shows the timing relationships of the CTO and IDM signals previously described. The position of the IDM signal is typically prior to the CTO falling edge but can also follow this edge.

FIG. 2 also shows the detailed relationship between CTO, IDM and the ion current signals along with the blanking one shot signal. The flat topped portion of the ion current wave form is the spark event which causes amplifier saturation. The blanking one shot is triggered by every spark event including re-strikes and prevents ion current sampling until this spark transient has decayed.

The signal processing algorithm begins when the signature IDM pulse for cylinder #1 is detected. At this point, the ionization detection system is synchronized for cylinder identification. Upon detection of each subsequent IDM pulse a blanking window 60 is initiated in the algorithm that has a duration of 2.2 milliseconds if the ignition system operation is single strike and 5.6milliseconds if the ignition system operation is multistrike.

A very diverse pattern of the ion current signals occurs in normal engine operation, so it is desirable to look at the integral of ion current to reduce variability.

A time-based integral with a highly variable measuring interval (changing RPM) would require normalization (areas under the curve are much larger at the low RPM than at high RPM). This difficulty is eliminated in the particular example by using a rotation-based integrator which takes the same number of samples regardless of RPM and maintains the same criterion for detection of misfire.

Immediately following the blanking window 60, a sampling window 62 is opened to allow sampling of ionization current. Sampling window 62 extends to the next spark event on the particular channel being monitored. Sampling window 62 is also divided into two windows shown a window 64 and window 66 in FIG. 2. Window 62 begins at the end of spark discharge and extends, in this particular example 150 degrees, past TDC of the cylinder being monitored. Window 66 occupies the remaining duration from the close of window 64 until the next ignition event on that channel.

As described in greater detail later herein with particular reference to FIG. 4, window 64 is used to monitor ionization resulting from a normal combustion event. And window 66 is monitored to determine if a slow burn or a late combustion event is occurring. Before describing such monitoring in detail, however, a description of the detailed circuit for detecting ionization current will be described with reference to FIG. 1 on the threshold generation will subsequently be described with particular reference to FIG. 3.

The circuit for detecting ionic current is now described with particular reference to FIG. 1. Circuit 20 includes a Zener diode 26, preferably 56 V, which carries current in the normal diode direction when the spark event occurs, and carries current in the Zener breakdown mode upon recovery from the spark event. The Zener diode voltage is greater than an ignition detection or bias supply voltage, VBias, applied to the spark plug by the circuit 20. Therefore, the rest of the circuit 20 is shut off at the appropriate time after the spark event and before the ion current flow which follows. This maximizes the window for acceptable sampling of the ion current. This is an important feature for fast burn engines.

In particular, Vbias is the ionization detection voltage which is applied to the spark plug 18 through a resistor 32, preferably 499 kilohms, which couples the inverting input 28 of the operational amplifier 30 to the node 24 which is also coupled to cathode of a first circuit element or Zener diode 34, preferably 39 V. The anode of the Zener diode 34 is connected to the cathode of the Zener diode 26.

Preferably, the operational amplifier 30 is a low offset voltage and low input bias current operational amplifier such as an LM 108. The non-inverting input 36 of the operational amplifier 30 is biased with the ionization detection voltage. The operational amplifier 30 also includes power supply voltages VBias+ΔV at input 38 and voltage VBias−ΔV at input 40. Preferably, VBias is on the order of 40 volts and ΔV is on the order of 10 volts.

A first feedback circuit in the form of a feedback resistor 42, preferably 499 kilohms, allows a mirror image (around 40 V) of the ionization detection voltage to be generated from the inverting input 28 to the output of the operational amplifier 30.

After the ionization detection voltage has been applied to the spark plug 18, the operational amplifier 30 generates a signal at its output having a magnitude based on the input voltage signal appearing at the node 24. The magnitude of the output signal from the operational amplifier 30 is compared with a predetermined threshold such as the ignition detection voltage at a threshold device, generally indicated at 44.

Figure 3:
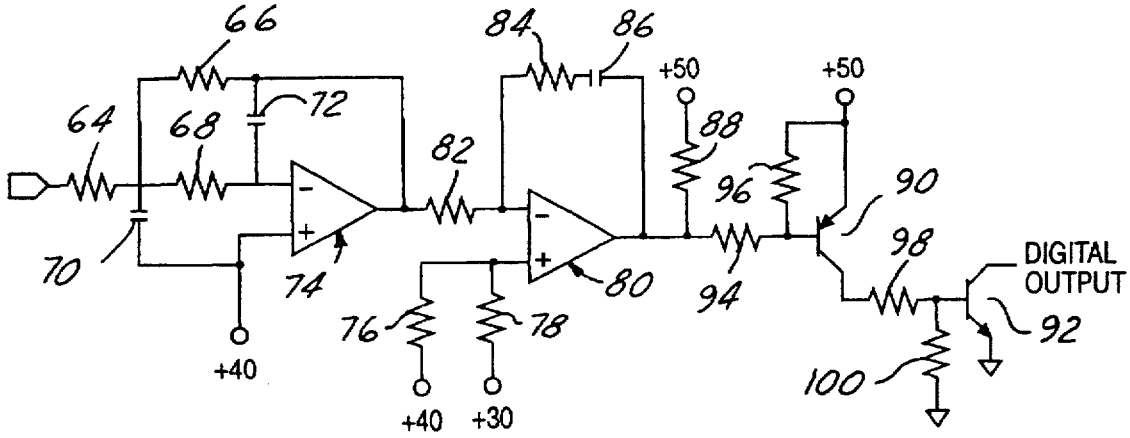
FIG. 3 is an electrical schematic of a portion of the embodiment shown in FIG. 1.

Referring to FIG. 3, the threshold device 44 is now described. Input into the threshold device 44 is obtained from the output of the operational amplifier 30. The device 44 includes resistors 64, 66, and 68, capacitors 70 and 72, and an operation amplifier 74 which collectively define an inverting unity gain amplifier. Preferably, the operational amplifier 74 is an LM 124 and resistors 64 and 66 have a value of 35.7 kilohms, resistor 68 has a value of 17.8 kilohms, capacitor 70 has a value of 0.039 microfarads, and capacitor 72 has a value of 0.01 microfarads. With this configuration, a filter cutoff frequency of 320 Hz with a 40 dB per decade roll-off is obtained.

The output of the operational amplifier 74 is a signal that is centered around a bias voltage of 40 Vdc. When ionization is present, the output of the operational amplifier 74 will drop from the 40 Vdc reference by an amount that is proportional to the magnitude of ionization.

The device 44 also includes resistors 76 and 78 (preferably 10 kilohms and 182 kilohms, respectively), and an operational amplifier 80, preferably an LM 139. The resistors 76 and 78 define a divider net work that determines the threshold level of the comparator 80.

The device 44 also includes resistors 82 and 84 which preferably have values of 10 kilohms and 1 megaohms, respectively, and a capacitor 86 which is preferably 200 picofarads.

The level of threshold voltage is set to 39.5 Vdc. When the output of the operational amplifier 74 falls below 39.5 Vdc, the output of the comparator 80 will switch to the lower rail voltage of 30 Vdc. If the output of the operational amplifier 74 is above 39.5 Vdc, then the output of the comparator 80 will be pulled up to 50 Vdc through the resistor 88, preferably 20 kilohms. If the output of the comparator 80 is a low level, then the transistor 90 is biased on which, in turn, provides a bias to the transistor 92 and will cause the transistor 92 to also turn on, pulling the digital output to ground level, thereby translating the level from VBias to ΔV to ground level. The device 44 typically includes resistors 94, 96, 98 and 100 which preferably have values of 100kilohms, 51 kilohms, 390 kilohms and 51 kilohms, respectively.

Therefore, when the level of ionization current has exceeded 1 microamp, the input voltage to the operational amplifier 80 will be below 39.5 Vdc and the digital output will be at zero volts. If the level of ionization current is below 1 microamp, the input voltage to the operational amplifier 80 will be above 39.5 Vdc and the digital output transistor 92 will turn off and the output voltage will be pulled up to a level established by the detection logic 22. The output of the threshold device 44 is coupled to the detection logic 22 to determine whether a misfire output signal should be generated by the detection logic 22 as previously described.

In order to avoid Zener diode leakage, the two Zener diodes 26 and 34 are utilized and a guard voltage signal is generated by a second operational amplifier, generally indicated at 46 in FIG. 1, together with its respective feedback circuitry, generally indicated at 48. The guard voltage signal is applied to the node or junction 50 between the two Zener diodes 34 and 26. The guard voltage is regulated to track the input voltage appearing at the cathode of the Zener diode 34 by the feedback circuit 48 surrounding the operational amplifier 46. Preferably, the operational amplifier is an LM 124 and the feedback circuit 48 is a resistive capacitance circuit wherein resistors 52 and 54 have values of 100kilohms, resistor 56 has a value of 20 kilohms, and capacitor 58 has a value of 51 picofarads.

Because the guard voltage is essentially the same as an input voltage appearing at the node 24, there is no leakage current flow through the Zener diode 34, Therefore, any voltage developed at the threshold device 44 is attributable exclusively to ionization current and very low signal levels can be detected.

The ionization detection circuit 20 depicts a single channel. An identical circuit is required for each channel. A single channel can monitor two cylinders that fire 360 degrees apart. Therefore, additional channels would be monitored by additional circuits 20 and can be coupled to detection logic 22 as indicated by the threshold and translator 102.

Figure 4:
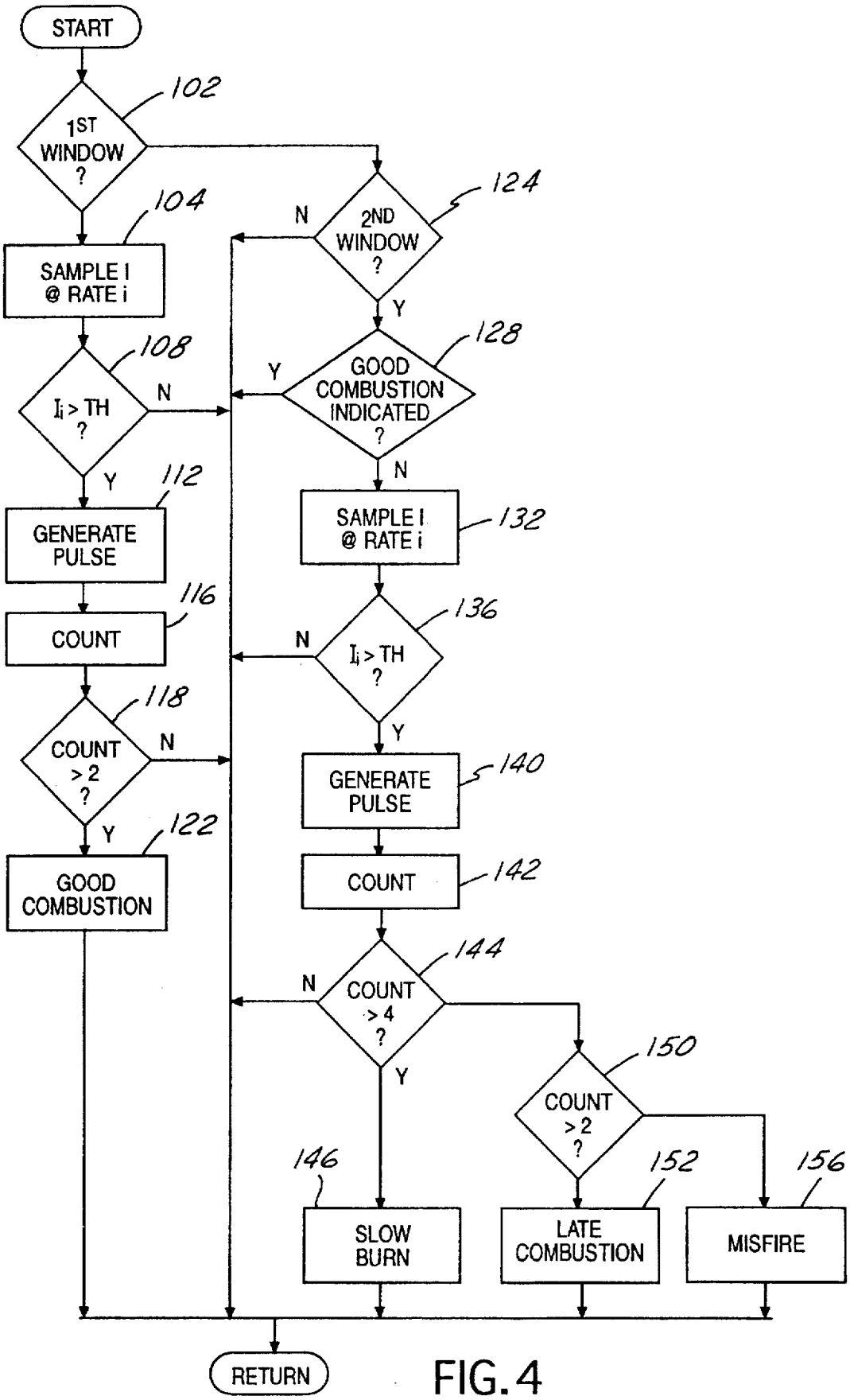
FIGS. 4 and 5 are flowcharts which depict engine operation in accordance with the embodiments shown in FIG. 1.

The state of engine combustion is now described with particular reference to the diagram shown in FIG. 4. When ignition timing is within first window 64 (block 102), ionic current is sampled at rate i (block 104). When the sampled ionic current $I_i$ is greater than threshold value TH (block 108), an indication pulse is generated at block 112. When the count of indicating pulses is greater than a threshold value, which is set as 2 in this particular example (blocks 116, 118), a good combustion event is indicated at block 122.

When ignition timing is within second window 66 (block 124), and a good combustion event was not indicated during combustion window 64 (block 128), ignition current is sampled at rate i (block 132). When sampled ionic current $I_i$ is greater than threshold value TH (block 136), an indicating pulse is generated at block 140. When the count of such indicating pulses (block 142) is greater than a preselected value, shown in this example as 4, a slow burn indication is provided (blocks 144 and 146).

On the other hand, when the indicating pulse count is greater than another preselected value, which is shown as 2 in this particular example (block 150), a minimal combustion event is indicated at block 152. And when the count of such pulses is less than the preselected value, which is 2 in this particular example (block 150), a misfire indication is provided at block 156.

Figure 5:
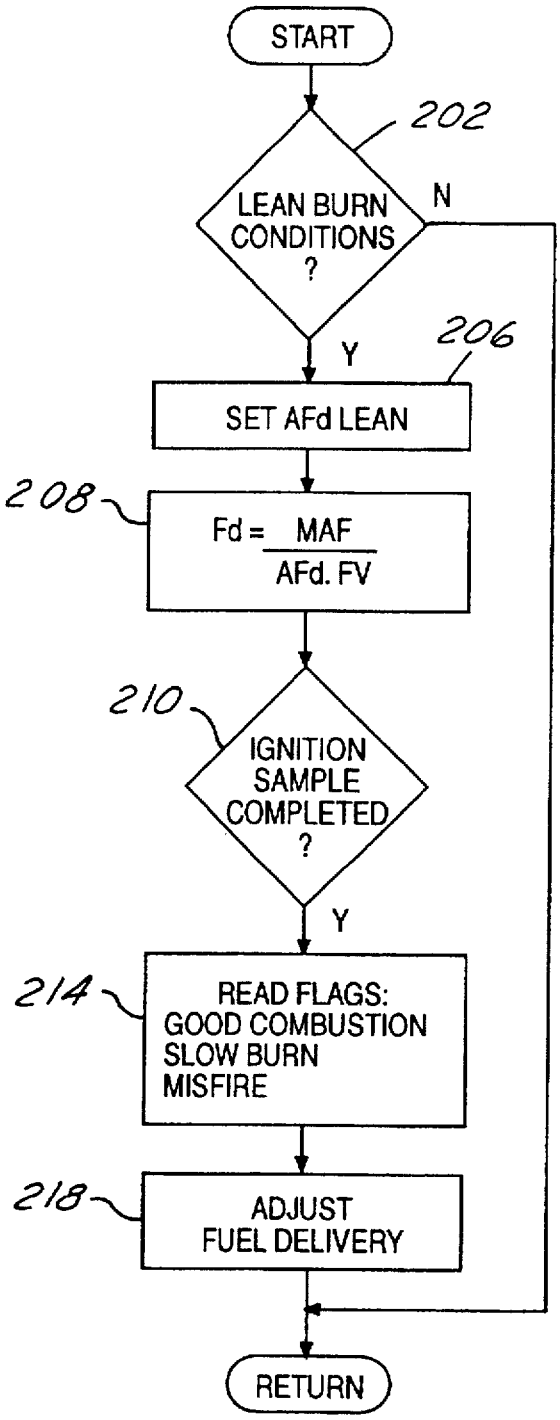

Referring now to FIG. 5, the use of the combustion indication, or combustion flags, in an exemplary engine control system is now described with particular reference to FIG. 5. In this example, the engine control system is applied to lean burn engine operation wherein the engine is operating at an air/fuel ratio lean of stoichiometry to achieve improved fuel economy. A difficulty with such lean operation is that air/fuel feedback control responsive to an exhaust gas oxygen sensor is not practical because the conventional exhaust gas oxygen sensor provides information only at stoichiometric air/fuel ratios. Without air/fuel control, the engine may inadvertently be operated at sufficiently lean air/fuel ratios to cause engine misfire or rough operation. As described below, the combustion indications, which were generated with particular reference to FIG. 4, are used to correct such rough engine operation or misfire while maintaining optimal fuel economy.

When lean burn operations are indicated (block 202), the desired air/fuel ratio AFd is set at a lean value such as in a range between 18–22 lbs.air/lb.fuel (block 206).

When the ionic current sample test for a particular cylinder is completed (block 210), the combustion indications or combustion flags, are read during block 214. Stated another way, when ionic current samples taken during windows 64 and 66 are completed, the combustion indicating flags generated by the process shown in FIG. 4 are read during block 214. More specifically, indications of "Good Combustion", "Slow Burn", and "Misfire" are read during block 214. Fuel delivered to the engine is then adjusted during block 218 in accordance with the combustion indications described above. For example, engine air/fuel operation will be changed more in a rich direction when a Misfire is indicated than when Slow Burn is indicated. And, the air/fuel ratio will either not change, or will be enleaned, when Good Combustion is indicated.

This concludes the description of an example in which the invention is used to advantage. Those familiar with the art to which this invention relates will recognize various alternative designs and embodiments for practicing the invention as defined by the following claims.

What is claimed:

1. A method for determining combustion quality in a combustion chamber of an internal combustion engine, comprising:

generating a first window of a first predetermined duration after an ignition event in the combustion chamber;

generating a second window of a second predetermined duration after said first window;

sampling ionic current flow in the combustion chamber at predetermined sample times during said first window;

sampling ionic current flow in the combustion chamber at predetermined sample times during said second window; and providing a combustion condition indication based upon said ionic current samples occurring during said first window and said ionic current samples occurring during said second window.

2. The method recited in claim 1 further comprising delivering fuel to the engine to operate the engine at a first air/fuel ratio lean of stoichiometry and increasing said delivered fuel in response to said combustion condition indication to operate the engine at a second air/fuel ratio lean of stoichiometry which is richer than said first air/fuel ratio.

3. The method recited in claim 1 wherein said step of providing a combustion indication further comprises a step of providing a first combustion indication state based upon said ionic current samples occurring during said first window.

4. The method recited in claim 3 wherein said step of providing a combustion indication further comprises a step of providing a second combustion indication state based upon said ionic current samples occurring during said second window in the absence of said first combustion indication state.

5. The method recited in claim 4 wherein said step of providing a combustion indication further comprises a step of providing a third combustion indication state based upon said ionic current samples occurring during said second window in the absence of both said first combustion indication state and said second combustion indication state.

6. The method recited in claim 4 wherein said step of providing a second combustion indication state further comprises a step of providing an indication of slow burn in the combustion chamber.

7. A method for adjusting fuel delivered to an internal combustion engine in response to a determination of combustion quality in a combustion chamber of the engine, comprising:

generating a first window of a first predetermined duration after an ignition event in the combustion chamber and a second window of a second predetermined duration after said first window;

sampling ionic current flow in the combustion chamber at predetermined sample times during said first window and at predetermined sample times during said second window;

generating a first count of comparisons of each of said ionic current samples occurring during said first window to a first threshold and generating a second count of comparisons of each of said ionic current samples occurring during said second window to a second threshold; and adjusting the fuel delivered to the engine in response to said first and said second comparison counts.

8. The method recited in claim 7 further comprising a step of providing a first combustion indication state based upon said first comparison count.

9. The method recited in claim 8 further comprising a step of providing a second combustion indication state based upon said second comparison count in the absence of said first combustion indication state.

10. The method recited in claim 9 wherein the engine is operating at an air/fuel ratio lean of a stoichiometric air/fuel ratio.

11. The method recited in claim 10 wherein said fuel adjusting step causes a first adjustment towards a richer air/fuel ratio in response to said absence of said first combustion indication state.

12. The method recited in claim 11 wherein said fuel adjusting step causes a second adjustment towards a richer air/fuel ratio in response to said second combustion indication state.

13. The method recited in claim 7 wherein said step of sampling ionic current flow comprises a step of applying electrical energy to electrodes of a spark plug coupled to the ignition chamber and measuring said ionic current flow between the electrodes.

14. An article of manufacture comprising:

a computer storage medium having a computer program encoded therein for causing a computer to adjust fuel delivered to an internal combustion engine in response to a determination of combustion quality in a combustion chamber of the engine, comprising:

window generating code means for causing a computer to generate a first window of a first predetermined duration after an ignition event in the combustion chamber and a second window of a second predetermined duration after said first window;

sampling code means for causing a computer to sample ionic current flow in the combustion chamber at predetermined sample times during said first window and at predetermined sample times during said second window;

comparison code means for causing a computer to generate a first count of comparisons of each of said ionic current samples occurring during said first window to a first threshold and generating a second count of comparisons of each of said ionic current samples occurring during said second window to a second threshold; and adjusting code means for causing a computer to adjust the fuel delivered to the engine in response to said first and said second comparison counts.

15. The article of manufacture recited in claim 11 wherein said computer storage medium comprises a memory chip.

* * * * *